US006834689B1

(12) United States Patent
Peters

(10) Patent No.: US 6,834,689 B1
(45) Date of Patent: Dec. 28, 2004

(54) METHOD AND APPARATUS FOR TRANSPORTING, STORING AND DISPENSING VISCOUS PRODUCTS

(75) Inventor: Janet K. Peters, Houston, TX (US)

(73) Assignee: Jaeco Technology, Inc., Houston, TX (US)

( * ) Notice: Subject to any disclaimer, the term of this patent is extended or adjusted under 35 U.S.C. 154(b) by 0 days.

(21) Appl. No.: 10/670,074

(22) Filed: Sep. 24, 2003

Related U.S. Application Data

(60) Provisional application No. 60/425,597, filed on Nov. 12, 2002.

(51) Int. Cl.[7] ..... B65B 1/04

(52) U.S. Cl. ..... 141/302; 141/27; 222/389

(58) Field of Search ..... 141/2, 18, 21–27, 141/67, 65, 59; 222/387, 389

(56) References Cited

U.S. PATENT DOCUMENTS 1,609,015 A * 11/1926 Engbrecht ..... 222/389
1,892,519 A * 12/1932 Schottgen ..... 141/27
3,829,025 A * 8/1974 McLeod ..... 239/373
4,445,629 A * 5/1984 Doerfler ..... 222/148
5,002,154 A * 3/1991 Chen ..... 184/1.5

* cited by examiner

*Primary Examiner*—Steven O. Douglas
(74) *Attorney, Agent, or Firm*—Kenneth A. Roddy

(57) ABSTRACT

Apparatus and method for transporting, storing and dispensing highly viscous material requiring dispensing pressures greater than 15 psig incorporates one or more cylindrical ASME pressure vessels having first and second ends, a product inlet and product dispensing valve at the first end, a bi-directional pipeline pig slidably disposed in the vessel in fluid sealing relation, a gas supply valve and a first gas vent valve connected with the second end, and a second gas vent valve connected with the vessel for venting gas from the vessel during a filling operation. The vessels are filled by venting gas from behind the pig and introducing viscous material into the vessel through the product inlet valve to move the pig toward the second end, and the viscous material is dispensed by introducing gas under pressure behind the pig at a pressure greater than 15 psig to move it toward the vessel first end to force the viscous material in the vessel through the product dispensing valve.

20 Claims, 5 Drawing Sheets

METHOD AND APPARATUS FOR TRANSPORTING, STORING AND DISPENSING VISCOUS PRODUCTS

CROSS REFERENCE TO RELATED APPLICATION

This application claims priority of U.S. Provisional Application Ser. No. 60/425,597, filed Nov. 12, 2002.

FIELD OF THE INVENTION

This invention relates generally to apparatus and methods for transporting, storing and dispensing very viscous semisolid products, and more particularly to an ASME pressure vessel having a pig delivery system whereby pressurized gas, greater than 15 psig, is used to effectively extrude viscous material out of the apparatus.

BRIEF DESCRIPTION OF THE PRIOR ART

As used herein, the term "tank" is used define a container limited to internal pressures of less than 15 psig, and the term "vessel" is used define a container capable of withstanding internal pressures of a magnitude greater than 15 psig. The prior art generally teaches "tanks", that are limited to internal pressures of less than 15 psig, and consequently, limited to dispensing products of low viscosity.

Bulk transport and dispensing of viscous semisolid products has commonly been accomplished in non-metallic and metallic containers capable of being pressurized with gas and having a piston follower which moves in response to the gas pressure applied to the top of the piston follower and thereby transferring force over a wide cross-sectional area to the viscous semisolid product below the piston follower and causing the semisolid product to flow from the container.

The prior art can be divided into two categories. The first category generally comprises small pressurized apparatus and dispensing methods utilized in non-bulk delivery and dispensing of small volumes of product like toothpaste and shaving cream. The second category of prior art generally comprises larger equipment designed to transport and dispense bulk volumes of semisolid products like grease or non-viscous products that must be isolated from the atmosphere. The terminology most often used to denote bulk liquid transportation equipment is "tote" or more precisely, an Intermediate Bulk Container or "IBC".

Typically, an Intermediate Bulk Container or "IBC" is simply a container ranging in size from 85 gallons to 550 gallons and come in a variety of shapes and are fabricated using a variety of materials, such as plastic, aluminum, steel and stainless steel. They are typically used for shipping bulk liquids and not intended to be capable of withstanding the application of internal pressure. The prior art dealing with the particular category of bulk transport and dispensing tanks specifically designed to be capable of withstanding internal pressures is typically limited to dispensing gas pressures having a magnitude of less than 15 psig.

In contrast, the apparatus and methods of the present invention are designed for the specific purpose of transporting, storing and dispensing highly viscous materials that require dispensing gas pressures of 15 psig and greater.

The low-pressure limitation of the prior art defines the difference between a "tank" or "IBC" of the prior art, and an ASME "pressure vessel" in accordance with the present invention. As discussed hereinafter below, prior art "tanks" and "IBC's" are designed and engineered to meet federal standards that are different from the federal standards that are met by the "ASME vessels" of the present invention, and is an important distinction and difference between the prior art and the present invention.

There are several patents that teach Intermediate Bulk Containers ("IBC's") and "tanks" for transport or storage and dispensing of semisolid and fluid materials, such as grease and oil, which utilize piston members with various specially designed seals that dispense the contents. Some of these patents recite inflation pressures for inflating the seals, but are silent as to the viscosities of the materials and the internal design pressure of the tank and the dispensing pressures. Since the containers are referred to as a "tank" and the tank diameters taught in the patents are large, it is assumed by reference to the ASME Boiler and Pressure Vessel Code, Section VIII, Division 1, for the design of pressure containing vessels, that the limiting design pressure is less than and/or substantially less than 15 psig, and consequently, that they are limited to dispensing products of low viscosity Watson, U.S. Pat. Nos. 4,721,235, 5,114,054, and 5,341,726, disclose an elongate generally cylindrical tank for transport or for storage in bulk of semisolid and fluid materials, such as grease and oil. The tank has cylindrical piston that carries a hollow inflatable seal in a circumferential channel around the piston. A pressurizing device varies the pressure within the seal between atmospheric pressure and a pressure higher than atmospheric wherein the seal expands and presses against the internal surface of the tank.

Watson, U.S. Pat. No. 5,746,112 discloses an elongate generally cylindrical tank for transport or for storage in bulk of semisolid and fluid materials, such as grease and oil. The tank has cylindrical piston and a piston member that carries an annular elastic seal. The seal has an annular crown projecting radially outwardly from the piston member and engageable with the interior surface of the tank. The seal has a pair of spaced apart legs supporting the crown, and an arrangement for squeezing the legs together to move the crown outwardly and cause it to be pressed against the interior surface of the tank with a pressure such that when the piston member slides in the tank a portion of the crown is maintained in sliding engagement with the interior surface thereby to wipe the material therefrom and to seal the piston member relative to the tank.

Popp et al, U.S. Pat, No. 5,887,750 discloses an intermediate bulk container ("IBC" or "tank") that is open substantially the full diameter at the top with an outwardly extending flange and an inner sealing band extending to a height above the top of the flange. A removable lid sitting on the body has a cylindrical side wall depending down and terminating with an outwardly extending lid flange forming an obtuse angle with the side wall, wherein the lid is adapted to sit on the open end of the body with the lid flange above the body flange and the sealing band overlapping the lid side wall. A channel is formed between the inner sealing band, the body flange and the lid flange. A gasket is placed in the channel and the gasket is compressed between the body flange and the lid flange for sealing the container. The large opening facilitates cryogenic cleaning of commodity residue from the interior. The system includes a rotating base to turn the container to facilitate freezing and removal of the residue.

Berry, Sr., et al, U.S. Pat. Nos. 6,027,123 and 6,325,384 disclose tank pistons with an improved seal and wiper that are used in conjunction with tanks for transporting semisolid and viscous materials such as grease, oil, ink, and the like. The improved seals consist of an annular rubber member with a hollow chamber filled with an open cell foam material such as polyurethane, or a gel such as silica gel. The material in the chamber is compressible and expandable to provide a seal about the piston. The pistons may also be provided with an annular wiper structure that extends about the outer forward periphery of the piston, and is forwardly angled at about 45 degrees relative to an axis of the piston. The wiper has a beveled end that makes contact with the interior surface of the tank to provide a cleaning action. A complementary second wiper may be added near the outer rearward periphery of the piston.

Popp et al, U.S. Pat. No. 6,206,248 discloses a piston for dispensing material from a tank that includes a nose section connected to a piston shaft. A recessed channel is located between the nose section and piston shaft. In the channel, there is a seal lifter over which a solid wiping seal is placed. Upon inflation, the seal lifter forces the wiping seal to extend beyond the periphery of the piston to come into sealing contact with the interior wall of the container.

U.S. Code of Federal Regulations 49 CFR Paragraph 178.705, incorporated herein by reference, lists the standards for metal Intermediate Bulk Containers or "IBC'S, such as those of the prior art. Paragraph 178.705 of 49 CFR discusses the required material properties and minimum wall thickness needed for the safe containment and transportation of hazardous materials in IBC's. 49 CFR178.705 subtopic iv paragraph C, subpart ii, states a requirement for hazardous material IBC's citing the start-to-discharge pressure of a pressure relief device fitted on an IBC may not be higher than 9 psig. Clearly, IBC's designed to satisfy the requirements of 49 CFR178.705 would not be suitable for the transport and dispensing of highly viscous materials requiring pressures of 15 psig and greater to displace the material from the IBC.

The present invention far exceeds the requirements for classification as an IBC. The vessels of the present invention have an internal operating pressure exceeding 15 psig, and are designed for the specific purpose of transporting, storing and dispensing viscous materials that will not dispense at pressures below 15 psig and require dispensing gas pressures of 15 psig and greater.

The pressure vessels of the present invention are constructed in accordance with ASME Boiler and Pressure Vessel Code, Section VIII, Division 1, incorporated herein by reference. U.S. Code of Federal Regulations 46 CFR Ch. 1, Paragraph 54.01-2 incorporates by reference, the ASME Boiler and Pressure Vessel Code, Section VIII, Division 1. Paragraphs U-1c(2)(h) and U-1c(2)(j) of Section VIII, Division 1, of the 2001 ASME Boiler and Pressure Vessel Code define the scope of application to the pressure design of vessels having an internal operating pressure greater than 103 kPa (15 psig) and less than 20685 kPA (3000 psig). Thus, although the pressure vessels in accordance with the present invention are used for transporting materials in a manner somewhat similar to an IBC, the normative reference and mandatory design requirements are dictated by those used for pressure vessels and not IBC's since the operating pressure is greater than 15 psig.

Pipeline pigs are commonly used in oifield and refinery operations. The conventional pipeline pig comprises a generally cylindrical plug that moves through the inside of a pipeline for the purpose of cleaning, dimensioning, inspecting, or to separate dissimilar fluids. Typically, the pigs have a metal (steel or aluminum) body or steel shaft and are equipped with annular flexible seals (scraper cups or discs) that seal on the interior diameter of the pipeline to allow the build-up of differential pressure required to propel the pig through the pipeline. These pigs are unidirectional if they have scraper cups and bidirectional if equipped with discs. Typically, pigs are launched into the pipeline through a pig launcher connected to the pipeline, and are received in a pig receiver or trap connected to the pipeline after they have made a successful run through the pipeline.

Pipeline pigs have not heretofore been employed in pressure vessels for the purpose of effectively extruding very viscous semisolid materials from the pressure vessel apparatus.

SUMMARY OF THE INVENTION

The present invention provides a method for the transportation and point-of-use dispensing of very viscous, semisolid products where the viscosity of the semisolid requires that the apparatus of the invention include the use of a pressure vessel(s) capable of withstanding internal pressure greater than 15 psig. With the method and the apparatus of the invention, semisolids having large viscosities may be safely transported, stored and dispensed.

The apparatus of the present invention generally comprises one or more pressure vessels, flanged on at least one end and mounted either vertically or horizontally on a skid base, with each vessel containing a bi-directional pipeline pig, which acts as a piston, whereby gas pressure may be introduced on one side of the pig, forcing the pig to move through the vessel until it stops at the end of the vessel, thereby displacing product material contained between the pig and the end of the vessel through an outlet located at the end of the vessel. The vessel(s) is outfitted with a pressure/vacuum relief device, an outlet isolation full port valve of a sufficient diameter for the dispensing of very viscous semisolid product, a gas connection and isolation valve for the introduction of pressurized gas, a vent valve for the evacuation of pressurized gas to atmosphere, a magnetically operated indicator or such other means for detecting the location of the pig inside the vessel. The skid comprises a base for securely attaching the vessel(s), with channel openings in the base to allow the skid to be picked up with a fork truck, and with lifting eyes included either on the skid or on the vessel(s) allowing the entire skid to be picked up with slings and shackles using an overhead crane.

The method of the invention allows filling of the apparatus with very viscous semisolid product, using a pump or such other method, making sure that the vent valve above the pig is open to allow displaced air or gas to escape, and whereby the vessel(s) is completely filled and the pig is displaced by product to the fullest extent of travel inside the vessel(s). The skid may be picked up, moved about and transported to the point of use. Dispensing is accomplished by positioning the skid in the appropriate location, supplying air or gas pressure at 15 to 125 psig pressure to the vessel connection, making sure the vent valve is closed, open the product valve, and slowly open the gas supply valve introducing pressure above the pig, causing it to move, thereby displacing product out of the vessel and product valve.

DESCRIPTION OF THE PREFERRED EMBODIMENTS

Figure 1B:
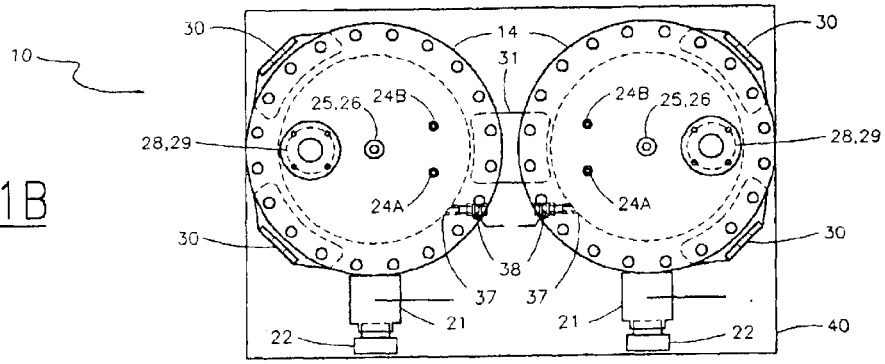
FIGS. 1A, 1B and 1C are a front elevation, top plan view, and left side elevation, respectively, of a preferred vertical embodiment of the apparatus for transporting, storing and dispensing very viscous semisolid products.
Figure 1A:
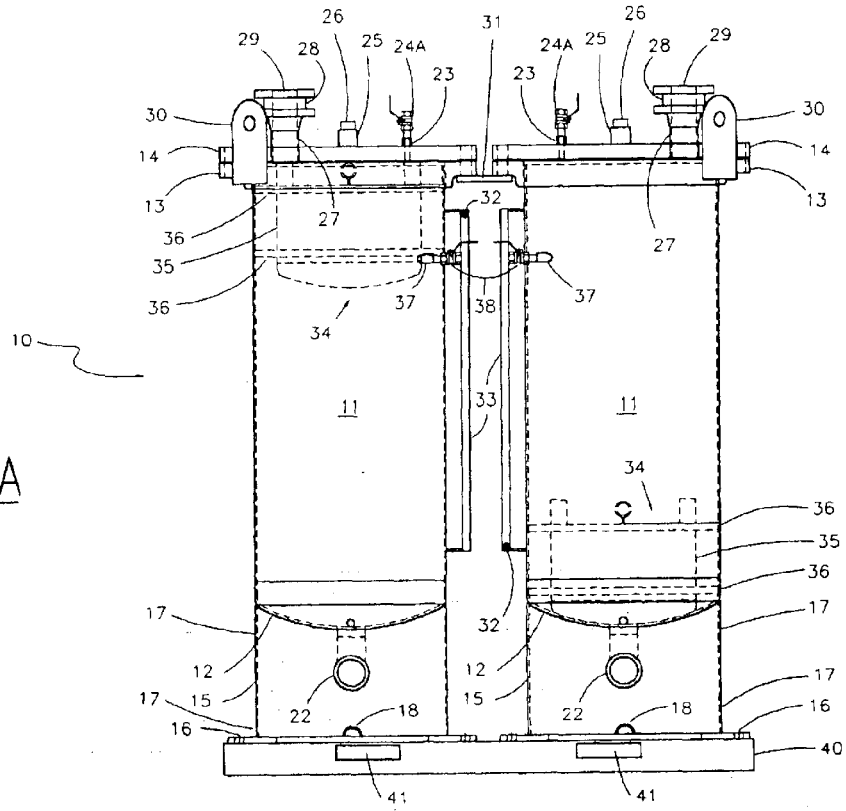
Figure 1C:
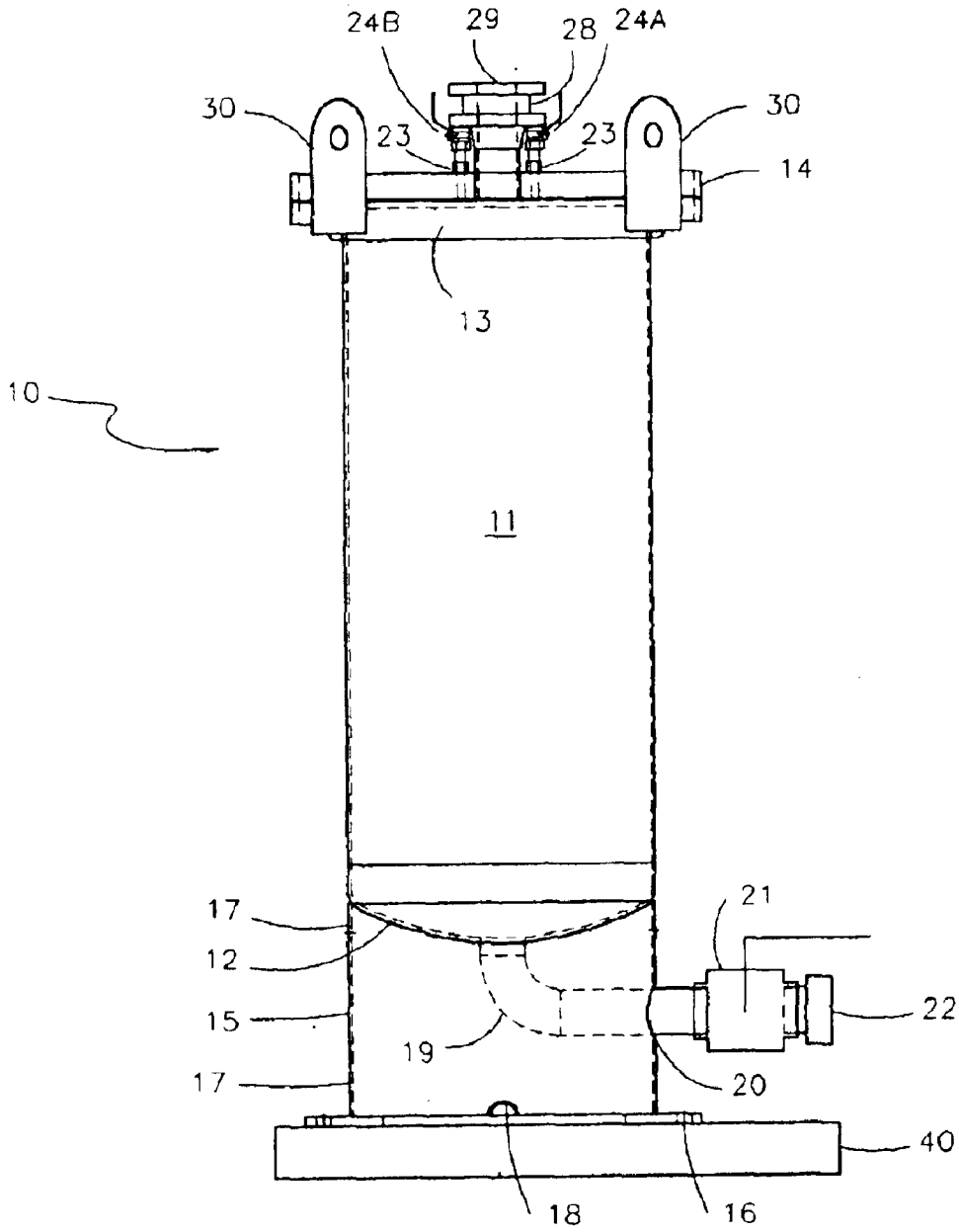

Referring to the drawing figures, and initially to FIGS. 1A, 1B and 1C, a preferred vertical embodiment 10 of the apparatus of the present invention is shown. The apparatus of the vertical assembly 10 comprises two cylindrical vessels 11, mounted vertically on a skid base 40. Each vessel 11 is a rolled and welded cylinder, with an American Society of Mechanical Engineers (ASME) flanged and dished head 12 welded on one end, a slip-on vessel body flange 13 welded on the opposite end, with a mating blind flange 14 bolted onto the slip-on flange 13. The bolts are conventional and therefore not shown.

A cylindrical vessel skirt 15 is welded to the lower end of each vessel 11 for supporting the vessel and is provided with a vessel skirt base ring 16 at its lower end, which is bolted or otherwise attached to the skid base 40 to secure the respective vessels to the skid base, and its side wall is provided with vent holes 17 and skirt drains 18. The bolting is conventional and therefore not shown.

Product outlet piping 19 is welded onto each vessel head 12 in fluid communication with the interior of the vessel and extends through an opening 20 in the vessel skirt 15. A product valve 21 is attached to the outer end of the piping 19 and a quick connect fitting 22, such as a Kamlok® fitting, is attached to the product valve.

A pair of attachment couplings 23 is welded to the blind flange 14 at the upper end of each vessel in fluid communication with the respective vessel interior, and small valves 24A and 24B are connected to the couplings for controlling the gas supply and gas venting. A pipe plug coupling 25 is welded to the blind flange 14 at the upper end of each vessel in fluid communication with the respective vessel interior and receives a pipe plug 26. A flanged coupling 27 is welded to the blind flange 14 at the upper end of each vessel in fluid communication with the respective vessel interior, and a rupture disc assembly 28 containing a combination pressure/vacuum rupture disc is held in place and bolted to the flanged coupling 27 by a flange 29.

Lift eyes 30 are bolted onto to underside of each vessel body flange 13 such that a single-point lift is achievable and safely rated to pick up the entire skid assembly including the full product weight. A stiffener 31 is attached to the underside of flanges 13 in the center between each vessel and distributes the load applied to the vessel base ring attachment when the skid is lifted with slings and shackles placed in the lifting eyes and lifted from the four attachment points on the vessels. Skid base 40 has channel slots 41 through the underside of the base spaced and sized for fork truck lifting from either side of the skid.

A small indicator magnetic 32 is slidably supported on the exterior of the side wall of each vessel 11 by clips 33. A bi-directional pipeline pig 34 is contained within the interior of each vessel 11. The pipeline pig 34 has a cylindrical body 35 with flexible annular seal discs 36 near each end that seal on the interior diameter of the respective vessel 11 to allow the build-up of differential pressure required to move the pig inside the vessel. As shown in FIG. 1A, the pig 34 in the vessel on the left side is shown in an upper position with the vessel in a full condition, and the pig in the vessel on the right side is shown in a lower position with the vessel in an empty condition.

In a preferred embodiment, the bi-directional pig 34 contains an internal magnet of sufficient magnetic strength to attract the small external indicator magnet 32 and move it through the same entire stroke distance of the pig such that the location of the pig is clearly visible from outside each vessel. Thus, the position of the small indicator magnets 32 visually indicates the location of the respective pig and, hence, the volumetric condition of the vessel between a full condition and an empty condition.

A coupling 37 is welded to the side wall of each vessel 11 in fluid communication with the respective vessel interior below the pig seal discs 36, and a small valve 38 is connected to each coupling for venting gas out of the vessel during the filling operation.

In some applications, the pig 34 may be provided with a flexible tubing line connected in fluid communication to the product side of the pig, through the pig body, and in fluid communication to an external vent valve located on the blind flange 14 such that gas may be vented from between the pig and the product during filling, thereby eliminating the side wall coupling 37 and gas vent valve 38.

Figure 2B:
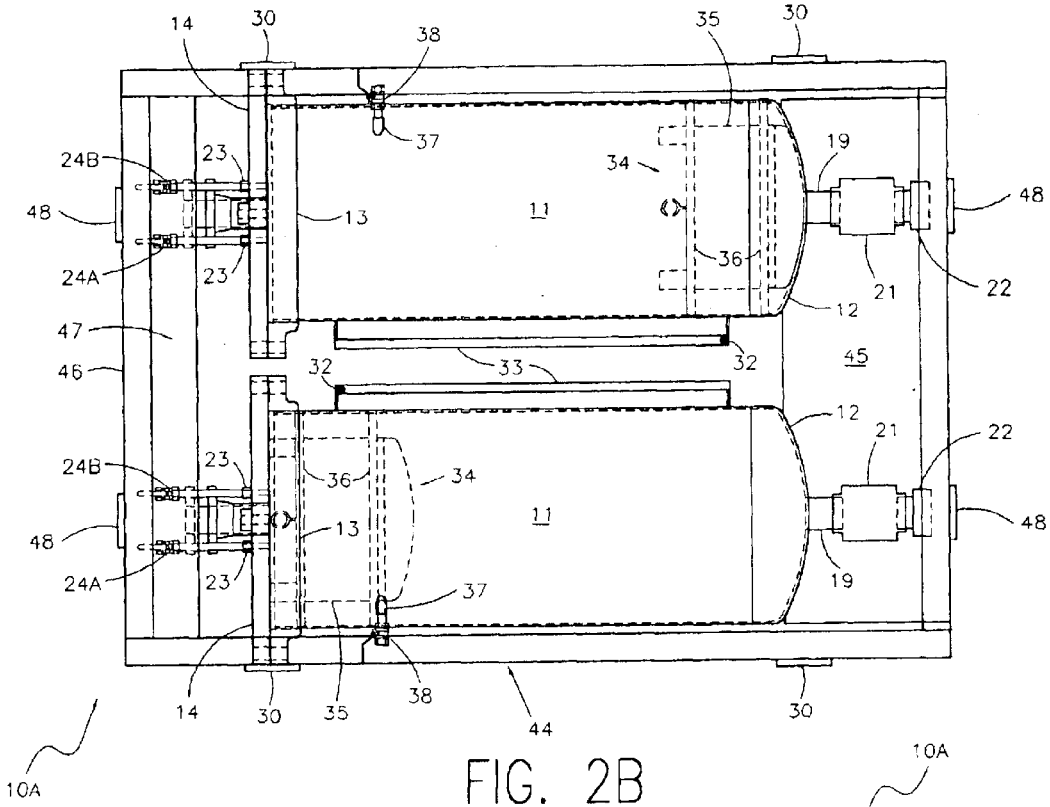
FIGS. 2A, 2B and 2C are a front elevation, top plan view, and left side elevation, respectively, of a preferred horizontal embodiment of the apparatus for transporting, storing and dispensing very viscous semisolid products.
Figure 2A:
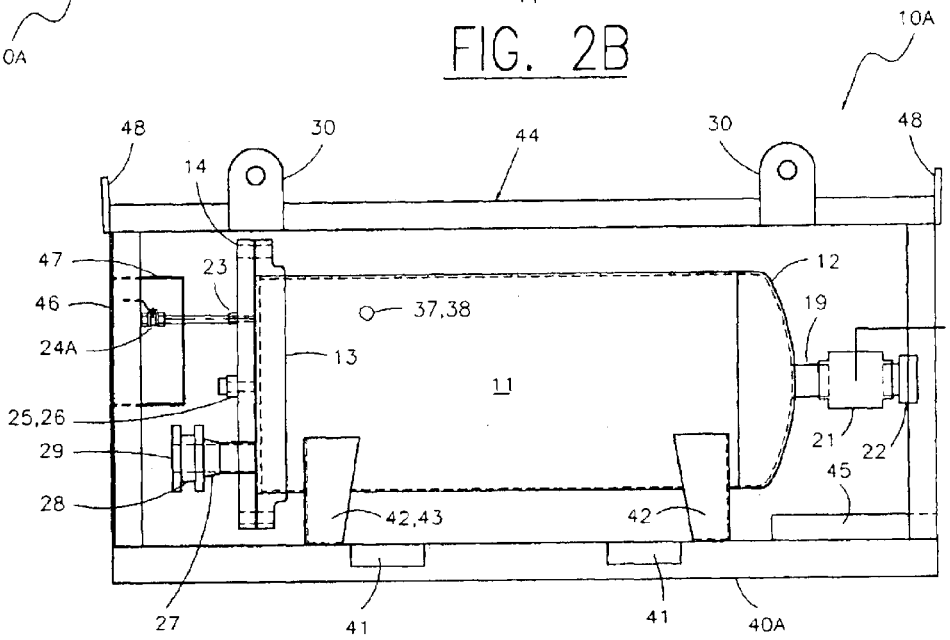
Figure 2C:
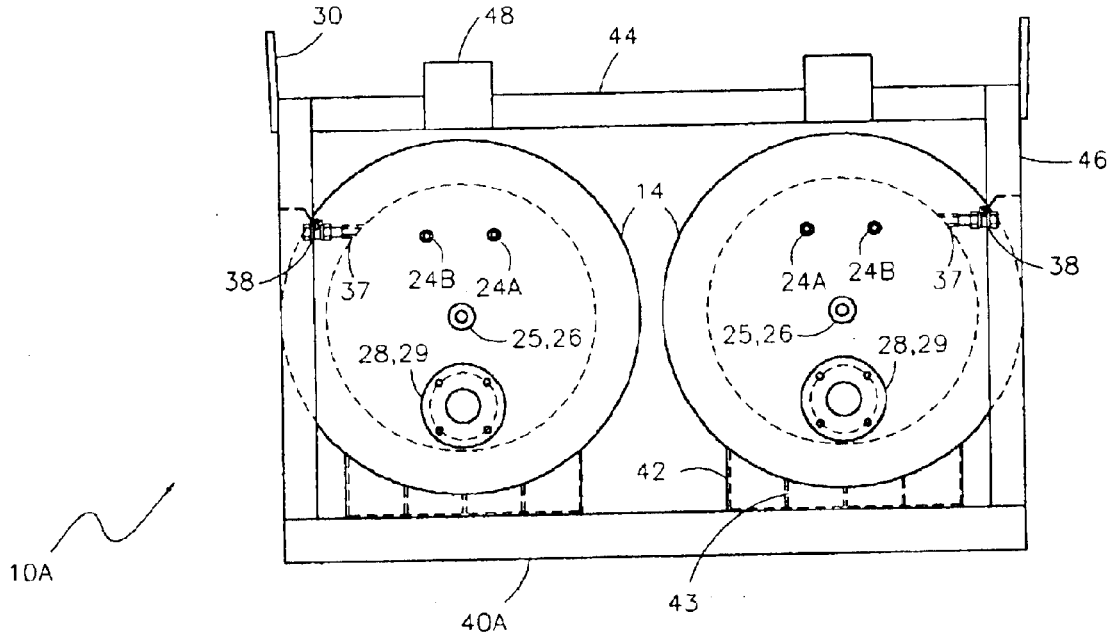

Referring now to FIGS. 2A, 2B and 2C, a preferred horizontal embodiment 10A of the apparatus of the present invention is shown. The apparatus of the horizontal assembly 10A comprises two cylindrical vessels 11, mounted horizontally on a skid base 40A in laterally spaced relation. Each vessel 11 is a rolled and welded cylinder, with an American Society of Mechanical Engineers (ASME) flanged and dished head 12 welded on one end, a slip-on vessel body flange 13 welded on the opposite end, with a mating blind flange 14 bolted onto the slip-on flange 13. The bolts are conventional and therefore not shown. Each cylindrical vessel 11 is supported on the skid base 40A by vessel saddles 42 with stiffeners 43 that are attached to the skid base and secured to the respective vessel.

As with the previous embodiment, product outlet piping 19 is welded onto each vessel head 12 in fluid communication with the interior of the vessel, a product valve 21 is attached to the outer end of the outlet piping and a quick connect fitting 22, such as a Kamlok® fitting, is attached to the product valve.

A pair of attachment couplings 23 is welded to the blind flange 14 at the upper end of each vessel in fluid communication with the respective vessel interior, and small valves 24A and 24B are connected to the couplings for controlling the gas supply and gas venting. A pipe plug coupling 25 is welded to the blind flange 14 at the upper end of each vessel in fluid communication with the respective vessel interior and receives a pipe plug 26. A flanged coupling 27 is welded to the blind flange 14 at the upper end of each vessel in fluid communication with the respective vessel interior, and a rupture disc assembly 28 containing a combination pressure/vacuum rupture disc is held in place and bolted to the flanged coupling 27 by a flange 29.

In this embodiment, the skid base 40A has a rectangular steel frame 44 configured to stack two skids, one on top of the other, and support the vessels 11 horizontally, including the full product weight. A product drip pan 45 is disposed beneath the outlet piping 19 and product valve 21. The skid frame 44 is provided with an endplate 46 and valve box 47 to cover and protect the small valves 24A and 24B from being damaged in transportation. The skid base 40A has channel slots 41 through the underside of the base spaced and sized to accommodate fork truck lifting from either side of the skid. Lift eyes 30 are welded to the sides of the skid frame 44 for lifting the assembly and side stacking stops 48 are welded to the upper ends of the skid frame 44 to guide and facilitate stacking two skids, one on top of the other.

A small indicator magnetic 32 is slidably supported on the exterior of the side wall of each vessel 11 by clips 33. A bi-directional pipeline pig 34 is contained within each vessel 11. The pipeline pig 34 has a cylindrical body 35 with flexible annular seal discs 36 near each end that seal on the interior diameter of the respective vessel 11 to allow the build-up of differential pressure required to move the pig inside the vessel. As shown from the top in FIG. 2B, the pig 34 in the lower vessel is shown at the left end of the vessel with the vessel in a full condition, and the pig in the upper vessel is shown at the right end of the vessel with the vessel in an empty condition.

A coupling 37 is welded to the side wall of each vessel 11 in fluid communication with the respective vessel interior below the pig seal discs 36, and a small valve 38 is connected to each coupling for venting gas out of the vessel during the filling operation.

In a preferred embodiment, the bi-directional pig 34 contains an internal magnet of sufficient magnetic strength to attract the small external indicator magnet 32 and move it through the same entire stroke distance of the pig such that the location of the pig is clearly visible from outside each vessel. Thus, the position of the small indicator magnets 32 visually indicates the location of the respective pig and, hence, the volumetric condition of the vessel between a full condition and an empty condition.

Alternatively, in the horizontally disposed embodiment, the pig 34 may be located by removing the pipe plug 26 and inserting a calibrated rod through the pipe plug coupling 25 and measuring the distance to the top of the pig.

Figure 3B:
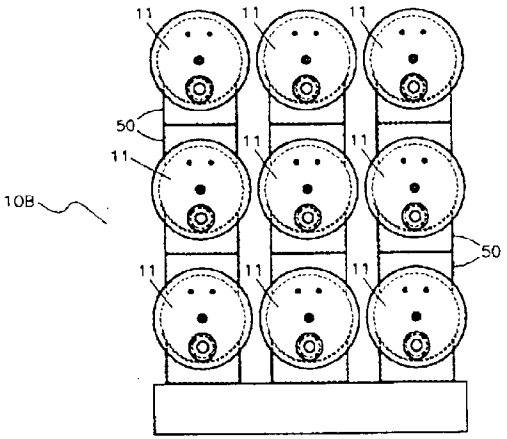
FIGS. 3A and 3B are a side elevation and left end view, respectively, of an alternate horizontal embodiment of the apparatus for transporting, storing and dispensing very viscous semisolid products.
Figure 3A:
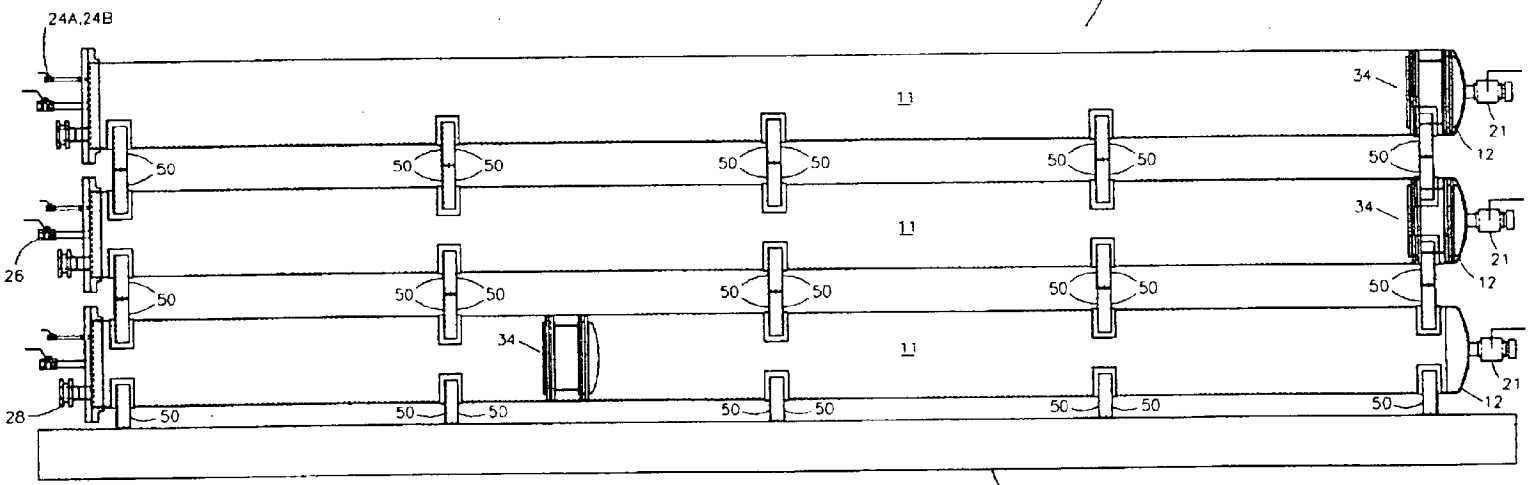

Referring now to FIGS. 3A and 3B, a modification 10B of the horizontal embodiment of the apparatus of the present invention is shown. In this modification, a plurality of the cylindrical vessels 11 (nine in the illustrated example) are supported in a bundle by saddles 50 in laterally and vertically spaced relation. In this embodiment, the vessels 11 are provided with the same components as described above, and some of the major components previously described are given the same numerals of reference, but all of the components are not shown and their detailed description is not be repeated here to avoid repetition. The product vessels 11 may be constructed from non-metallic material such as fiber reinforced plastic (FRP) to reduce the transportation weight of the invention. In this embodiment, the normative reference for non-metallic pressure vessels may still be found in the ASME Section VIII, Division 1, Code. Certain United States Department of Transportation requirements also form the basis of normative reference for this embodiment of the invention.

Also, in this embodiment, the coupling 37 and the vent valve 38 may be located on the flange 14 at the end of the vessels, rather than on the side wall.

In another modification, one of the vessels 11 may be replaced by a gas supply cylinder, whereby remote location dispensing of product may be accomplished using the self-contained gas supply.

It should be understood that the plurality of vessels may be supported in a frame on a skid base 40B, and may be oriented with their longitudinal axis in a vertical plane, as described previously. Such orientation may be used primarily for point-of-use product storage.

The bi-directional pipeline pig 34 forming an integral component of the present invention may be supplied either with or without an internal magnet. Pipeline pigs suitable for use in the present invention are commercially available. For example, Girard Industries, Inc., of Houston, Tex., produces a commercially available pipeline pig suitable for use in the present invention. The use of a commercially available pipeline pig eliminates an expensive specially designed piston.

It should be clearly understood that the vessels 11 in each embodiment of the present invention, made from either metallic or suitable non-metallic materials, are "pressure vessels", as opposed to low-pressure "tanks", and consequently are designed in accordance with the ASME Boiler and Pressure Vessel Code (B&PV), Section VIII, Division 1, and carry a nameplate showing a registered 'U' stamp mark on each vessel. This design basis allows the operating pressure to displace highly viscous products from the apparatus of the invention to exceed 15 psig and accordingly for the pressure vessels to be designed for the maximum design pressure required to safely contain the dispensing gas pressure and for the expected external loads which may occur during transportation.

OPERATION

The method of filling and dispensing is the same in all embodiments of the invention. The following discussion will refer to the horizontal embodiment of FIGS. 2A, 2B and 2C for purposes of example. The skid 40 is positioned for filling with vent valves 24B and 38 open, with the product valve 21 open, and with a hose or other such means of connection attached to quick connect coupling 22 and further connected to a pump suitable for pumping very viscous semisolid product. Product is introduced through the product valve 21 and the vessel interior is completely filled until product emerges from vent valve 38.

Dispensing is accomplished by positioning the skid, attaching a shop air or other suitable gas supply to a quick connect fitting on valve 24A, and with valve 24A in the closed position, with all other small valves closed, with product valve 21 open, valve 24A is slowly opened introducing pressure to the vessel interior above the pig 34, causing the pig to displace product out of the vessel interior and out of the product valve 21.

If the vessel is outfitted with the magnetic external pig location indicator and the indicator has calibration marks proportional to product volume, the product may be metered out in the desired quantities by watching the pig movement and stopping the pig, by closing the gas supply valve 24A, at the desired mark thereby dispensing the desired amount of product.

As a general and non-limiting example, consider an apparatus within the scope of the invention in which each vessel 11 is 24" in diameter and has a product holding capacity of 80 gallons. Although two vessels per skid have been described, it should be understood that the invention may use a single vessel or more than two vessels per skid and may be of any suitable diameter up to 48" or where the limiting diameter is based on the availability of a suitable commercial pipeline pig. It should be further understood, particularly in the horizontally disposed arrangement of the vessel(s), that the skid may be relatively long, of substantially larger product holding capacity, and may also incorporate a gas supply cylinder into the assembly for remote location utilization.

In the example of FIGS. 2A, 2B and 2C, the skid base is constructed of steel and is 7'–6" long, 5'–0" wide, and 4'–0"

tall. The horizontally disposed skids may be stacked two high. The skid dry weight, fully assembly as shown, is approximately 3500 lbs. The skid is designed to contain product densities, fully loaded, up to 17 pounds per gallon and is of a very rugged design suitable for transporting and storing products in virtually any environment, including offshore marine environments.

The vessels, by non-limiting example, have a design pressure of 150 psig and an operating pressure of 125 psig. The wetted metal parts of the assembly shown may be constructed of 316L stainless steel or other such pressure vessel material suitable for carrying corrosive viscous products. The vessels are protected from overpressure and vacuum by a non-fragmenting combination double-acting pressure/vacuum rupture disc set at 138 psig positive pressure with a burst tolerance of + or −5% and a beginning relief point of 1" water column vacuum and ending relief point of 30" water column vacuum. The rupture disc is easily replaceable should a relief event occur.

The apparatus of this example has been tested using a proprietary very viscous concentrated polymer having a density of 13.1 pounds per gallon and exhibiting a threshold breaking pressure to initiate movement of the material out of the apparatus of 34 psig. The pressure required to move the pig back and forth without product is approximately 6 to 8 psig.

The pig displacement for 80 gallons of product volume is approximately 43" and the pig is preferably contoured on the product side to match the vessel head and displace as near to empty as possible. Each vessel may be closely calibrated for exact product delivery volume by adjusting travel stops located on the gas side of the pig. It should be noted here that the pig cannot travel the full displacement distance inside a dented vessel. Thus, the vessel wall thickness, at the diameters of interest, required to contain the operating pressure of interest, is substantial enough to prevent minor dents from occurring. Should a vessel become dented, the vessel cylinder should be cut out and replaced.

The skid of the example may be lifted and transported using a fork truck or a crane.

Should the present invention be employed to transport any of the hazardous materials listed in the United States Federal Register 49 CFR Part 172, Table 101, 49 CFR Parts 100-185 contain the requirements for IBC design, qualification, testing, inspection, marking, etc. Chief amoung these requirements are a hydrostatic pressure test and drop test. The design of the present invention, although not executed specifically for the transportation of hazardous cargo, will pass the test requirements and design certification requirements contained in 49 CFR.

While this invention has been described fully and completely with special emphasis upon preferred embodiments, it should be understood that within the scope of the appended claims the invention may be practiced otherwise than as specifically described herein.

What is claimed is:

1. Apparatus for transporting, storing and dispensing highly viscous material, comprising:

at least one elongate cylindrical pressure vessel having a longitudinal axis and enclosed first and second ends for containing and transporting viscous material;

product inlet means and product dispensing means at said vessel first end for introducing viscous material into said vessel and dispensing it therefrom;

a bi-directional pipeline pig slidably disposed in said vessel to move relative thereto and having a circumferential seal engaged in a sliding fluid sealing relation with the interior surface of said vessel; and a gas supply valve and a first gas vent valve connected with said vessel second end for introducing gas under pressure into said vessel behind said pig and venting gas therefrom, respectively, and a second gas vent valve connected with said vessel for venting pressurized gas from said vessel during a filling operation;

said vessel filled by venting gas from behind said pig and introducing viscous material into said vessel through said product inlet means thereby moving said pig in a first direction toward said vessel second end, and the viscous material being dispensed by introducing gas under pressure behind said pig thereby moving said pig in a second direction toward said vessel first end to force the viscous material in said vessel through said product dispensing means.

2. The apparatus according to claim 1, wherein said pressure vessel is manufactured in accordance with ASME Boiler and Pressure Vessel Code, Section VIII, Division 1 specifications to withstand an internal operating pressure greater than 15 psig; and said pig is moved by gas pressure greater than 15 psig to force the viscous material in said vessel through said product dispensing means.

3. The apparatus according to claim 1, further comprising:

pressure relief means on said pressure vessel operative to relieve positive or negative pressure within said pressure vessel upon exceeding a predetermined limit.

4. The apparatus according to claim 3, wherein said pressure relief means comprises a rupture disc.

5. The apparatus according to claim 1, further comprising:

indicator means connected with said pressure vessel responsive to the movement and position of said pig to indicate the location of said pig inside said pressure vessel.

6. The apparatus according to claim 1, wherein said product inlet means and said product dispensing means comprise a valve at said vessel first end operative to introduce viscous material into said vessel and dispense it therefrom.

7. The apparatus according to claim 1, wherein said elongate cylindrical pressure vessel is mounted on a skid base.

8. The apparatus according to claim 7, further comprising:

a gas supply cylinder mounted on said skid base adapted to be connected with said gas supply valve for supplying gas under pressure into said vessel behind said pig.

9. The apparatus according to claim 7, wherein said elongate cylindrical pressure vessel is mounted on said skid base with its longitudinal axis disposed generally vertically and its said first end facing downward.

10. The apparatus according to claim 7, wherein a plurality of said elongate cylindrical pressure vessels are mounted on said skid base in laterally spaced relation with their longitudinal axis disposed generally vertically and their said first ends facing downward.

11. The apparatus according to claim 7, further comprising:

apertures in said skid base adapted to receive the tines of a fork lift truck for lifting said skid base and said pressure vessel.

12. The apparatus according to claim 7, further comprising:

lift eye means on said pressure vessel for lifting said skid base and said pressure vessel with a crane.

13. The apparatus according to claim 7, wherein said elongate cylindrical pressure vessel is mounted on said skid base with its longitudinal axis disposed generally horizontally.

14. The apparatus according to claim 13, wherein said skid base has a generally rectangular frame extending upwardly therefrom; and said elongate cylindrical pressure vessel is mounted on said skid base within said frame with its longitudinal axis disposed generally horizontally.

15. The apparatus according to claim 14, wherein a plurality of said elongate cylindrical pressure vessels are mounted on said skid base within said frame in laterally spaced relation with their longitudinal axis disposed generally horizontally.

16. The apparatus according to claim 14, wherein said frame is sized and shaped to allow stacking of one said skid base, frame and pressure vessel assembly on top of another said skid base, frame and pressure vessel assembly.

17. The apparatus according to claim 13, wherein said plurality of said elongate cylindrical pressure vessels are mounted on said skid base and supported in laterally spaced and vertically spaced relation with their longitudinal axis disposed generally horizontally.

18. A method of containing and dispensing highly viscous material, comprising the steps of:

providing at least one elongate cylindrical pressure vessel for containing viscous material, the vessel having a longitudinal axis and enclosed first and second ends, product inlet means and product dispensing means at said first end, a bi-directional pipeline pig slidably disposed in said vessel and having a circumferential seal engaged in a sliding fluid sealing relation with the interior surface thereof, a gas supply valve and a first gas vent valve connected with said second end, and a second gas vent valve connected with said vessel for venting pressurized gas from said vessel during a filling operation;

filling said vessel by venting gas from behind said pig and introducing viscous material into said vessel through said product inlet means thereby moving said pig in a first direction toward said vessel second end; and dispensing the viscous material from said vessel by introducing gas under pressure behind said pig thereby moving said pig in a second direction toward said vessel first end to force the viscous material in said vessel through said product dispensing means.

19. The method according to claim 18, wherein said pressure vessel is manufactured in accordance with ASME Boiler and Pressure Vessel Code, Section VIII, Division 1 specifications to withstand an internal operating pressure greater than 15 psig; and said pig is moved by introducing gas behind said pig at a pressure greater than 15 psig to force the viscous material in said vessel through said product dispensing means.

20. The combination of an ASME pressure vessel and a pipeline pig for use in transporting, storing and dispensing highly viscous material, comprising:

at least one elongate cylindrical pressure vessel manufactured in accordance with ASME Boiler and Pressure Vessel Code, Section VIII, Division 1 specifications to withstand an internal operating pressure greater than 15 psig;

said pressure vessel having a longitudinal axis and enclosed first and second ends for containing and transporting viscous material, product inlet means and product dispensing means at said first end for introducing viscous material into said vessel and dispensing it therefrom;

said pipeline pig comprising a bi-directional pipeline pig slidably disposed in said vessel to move relative thereto and having a circumferential seal engaged in a sliding fluid sealing relation with the interior surface of said vessel; and said pressure vessel having a gas supply valve and a first gas vent valve connected with said second end for introducing gas under pressure into said vessel behind said pig and venting gas therefrom, respectively, and a second gas vent valve connected with said vessel for venting pressurized gas from said vessel during a filling operation;

said vessel filled by venting gas from behind said pig and introducing viscous material into said vessel through said product inlet means thereby moving said pig in a first direction toward said vessel second end, and the viscous material being dispensed by introducing gas under pressure behind said pig thereby moving said pig in a second direction toward said vessel first end to force the viscous material in said vessel through said product dispensing means.

* * * * *